US005551671A

United States Patent [19]

McKenzie

[11] Patent Number: 5,551,671

[45] Date of Patent: Sep. 3, 1996

[54] HOT ARGON CLEANING AND PROTECTIVE COATING OF COMPONENTS MADE OF METAL OR ALLOY

[75] Inventor: Gerald W. McKenzie, Wilmington, N.C.

[73] Assignee: General Electric Company, Wilmington, N.C.

[21] Appl. No.: 281,400

[22] Filed: Jul. 27, 1994

[51] Int. Cl.[6] ..... C21B 7/22

[52] U.S. Cl. ..... 266/156; 266/257; 432/72

[58] Field of Search ..... 266/210, 252, 266/156, 249, 257; 432/144, 145, 152, 72

[56] References Cited

U.S. PATENT DOCUMENTS

| | | | |
|---|---|---|---|
| 3,111,434 | 11/1963 | Takao | 148/212 |
| 3,593,495 | 7/1971 | Ellison | 55/268 |
| 3,601,900 | 8/1971 | Erisman | 34/79 |
| 3,899,392 | 8/1975 | Grossman et al. | 376/418 |
| 4,191,598 | 3/1980 | Conybear et al. | 148/216 |
| 4,220,460 | 4/1980 | Grossman et al. | 420/422 |
| 4,312,669 | 1/1982 | Boffito et al. | 420/422 |
| 4,989,433 | 2/1991 | Harmon et al. | 72/38 |

FOREIGN PATENT DOCUMENTS

| | | | |
|---|---|---|---|
| 555952 | 4/1958 | Canada | 148/281 |
| 423377 | 4/1991 | European Pat. Off. | 34/15 |
| 3-267358 | 11/1991 | Japan | 148/207 |

*Primary Examiner*—Sikyin Ip
*Attorney, Agent, or Firm*—James E. McGinness

[57] ABSTRACT

The surfaces of a metal or alloy component are scrubbed by a high-velocity stream of inert gas at temperatures which facilitate removal of contaminants. Simultaneous with scrubbing, the impurities are captured in a separated loop of one or more "getter" filters operating at optimized temperatures. The scrubbing and "getting" functions are followed by a rapid elevation of the temperature of the component by heating the inert gas, now essentially free of contaminants which would otherwise react with the component surface at the elevated temperatures. Thereafter, a specific protective layer-forming agent is introduced into the inert gas stream at an ideal temperature, which agent will react predictably with the component being treated to form a predetermined protective coating on its surface.

6 Claims, 1 Drawing Sheet

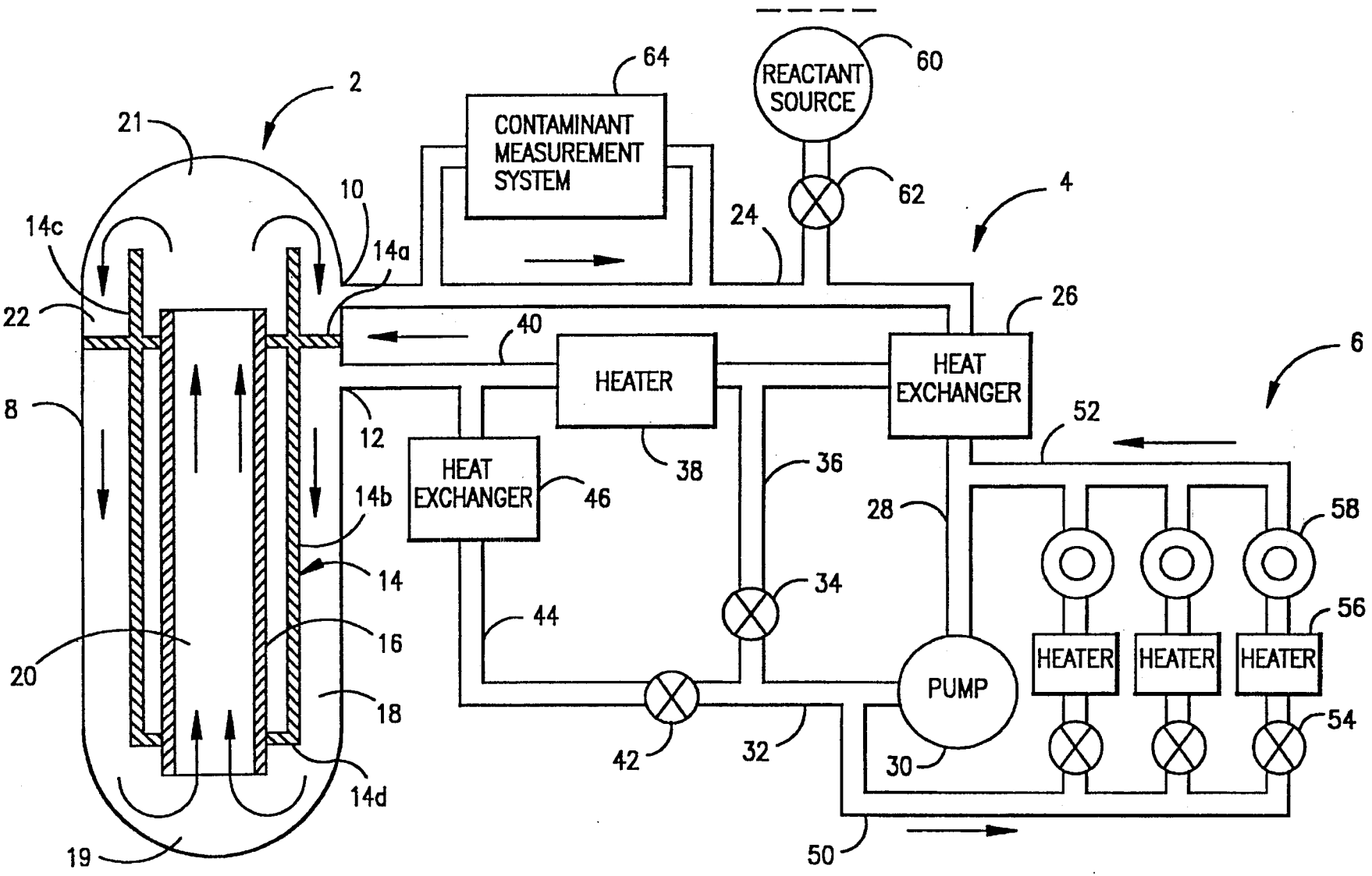
REACTANT SOURCE
CONTAMINANT MEASUREMENT SYSTEM
HEAT EXCHANGER
HEATER
HEAT EXCHANGER
PUMP
HEATER
HEATER
HEATER
2
4
6
8
10
12
14
14a
14b
14c
14d
16
18
19
20
21
22
24
26
28
30
32
34
36
38
40
42
44
46
50
52
54
56
58
60
62
64

HOT ARGON CLEANING AND PROTECTIVE COATING OF COMPONENTS MADE OF METAL OR ALLOY

FIELD OF THE INVENTION

This invention generally relates to a method for cleaning the surface of a component made of metal or alloy and then coating the cleaned surface with a protective layer to protect against contamination and corrosion caused thereby. In particular, the invention relates to a method for cleaning and protecting the surfaces of cladding, fuel channels and other nuclear reactor components made from metal alloy, such as zirconium-based alloy.

BACKGROUND OF THE INVENTION

The nuclear fuel material of a boiling water reactor is usually enclosed in a corrosion-resistant, non-reactive, heat-conductive container or cladding. The fuel cladding serves two primary purposes: first, to prevent contact and chemical reactions between the nuclear fuel and either the coolant or moderator if present, or both; and second, to prevent the highly radioactive fission products, some of which are gases, from being released from the fuel into the coolant or moderator or both. Common cladding materials are stainless steel, aluminum and its alloy, zirconium and its alloys, niobium (columbium), certain magnesium alloys, and others. The failure of the cladding, due to the build-up of gas pressure or high temperatures in the fuel, can contaminate the coolant or moderator and the associated systems with intensely radioactive long-lived products to a degree which interferes with plant operation.

Problems have been encountered in the manufacture and in the operation of nuclear fuel elements which employ certain metals and alloys as the cladding material due to the reactivity of these materials under certain circumstances. Under normal circumstances, zirconium and its alloys, i.e., Zircaloy-2 and Zircaloy-4, are excellent materials for use as nuclear fuel cladding since they have low neutron absorption cross sections and at temperatures below about 750° F. are strong, ductile, extremely stable and non-reactive in the presence of demineralized water or steam, which are commonly used as reactor coolants and moderators. Zircaloy is an alloy of zirconium with small amounts of iron, tin and other alloy metals. In particular, Zircaloy-2 contains about 1.5% tin, 0.15% iron, 0.1% chromium, 0.05% nickel and 0.1% oxygen, whereas Zircaloy-4 contains substantially no nickel and about 0.2% iron but otherwise is similar to Zircaloy-2.

Within the confines of a sealed fuel rod, however, the hydrogen gas generated by the slow reaction between the cladding and residual water may build up to levels which, under certain conditions, can result in localized hydriding of the alloy with concurrent deterioration in the mechanical properties of the alloy. Zircaloy cladding is also adversely affected by such gases as oxygen, nitrogen, carbon monoxide and carbon dioxide at all reactor operating temperatures. These gases react with Zircaloy and other alloys to produce corrosion which can compromise the integrity of the cladding over long service times.

The Zircaloy cladding of a nuclear fuel element is exposed to one or more of the aforementioned gases during irradiation in a nuclear reactor. Sintered refractory and ceramic compositions, such as uranium dioxide and others used as nuclear fuel, release measurable quantities of the aforementioned gases upon heating, such as during fuel element manufacture or especially during irradiation. The reaction of these gases with Zircaloy can result in embrittlement of the cladding which endangers the integrity of the fuel element. Although water and water vapor may not react directly to produce this result, at high temperatures water vapor does react with zirconium and zirconium alloys to produce hydrogen and this gas further reacts locally with the zirconium and zirconium alloys to cause embrittlement.

In light of the foregoing, it is desirable to eliminate, as far as possible, water, water vapor and gases reactive with Zircaloy from the ambient atmosphere during manufacture of cladding. It is also desirable to remove residual contaminants, for example, hydrocarbon-based lubricant, from the surfaces of Zircaloy cladding, which residue can lead to localized corrosion. This is equally true for other Zircaloy components of a nuclear reactor, such as fuel channels, as well as for components made of alloys which are not zirconium-based.

SUMMARY OF THE INVENTION

The present invention is a method for cleaning the surface of metal or alloy components, such as fuel cladding and fuel channels, and then coating the cleaned surface with a protective layer, substantially impervious to contaminants, for protection against corrosion. The cleaning step in accordance with the invention utilizes a high-velocity stream of inert gas circulating through a treatment chamber to remove or scrub residual contamination, such as hydrocarbon-based lubricant, from the workpiece surface to be cleaned. The force of the inert gas flowing over the workpiece surface at high speed lifts residue, e.g., a film of oil, from the surface. This residue is vaporized into the stream of inert gas which exits the treatment chamber.

A portion of the recirculating inert gas stream carrying vaporized contaminants is diverted to one or more getter systems or loops. Each getter is designed to capture a specific type of contaminant in gaseous/vapor form by reaction with and/or adsorption by an appropriate getter material. The getters are of conventional construction, that is, getter material arranged in an open structure which allows the inert gas to flow therethrough. The getter material has a surface area-to-volume ratio which ensures that substantially all of the targeted contaminant is removed from the diverted gas phase.

Scrubbing is performed while the main inert gas stream remains below the temperature at which the surface to be cleaned is sensitive or reactive to non-inert, i.e., reactive, gases. The getter loops, on the other hand, are operated at a temperature above the temperature at which the surface to be cleaned is sensitive to reactive gases, thereby facilitating "getting" or capture of the respective targeted contaminants.

The getter loops divert only a percentage of the main inert gas flow. The particular percentage is selected so that in the time needed by the getter loops to remove substantially all of the targeted contaminants from the main inert gas stream, the heated diverted gas phase will not raise the temperature of the main inert gas stream by enough to sensitize the workpiece surface to react with those contaminants.

In accordance with the preferred embodiment of the invention, the levels of targeted gas contaminant are monitored by a gas contaminant measurement system. When this system detects an acceptable gas purity level, then the inert gas stream is heated to a temperature at which the scrubbed workpiece surface is readily amenable to obtaining a uniform protective surface condition when an agent is injected into the main inert gas stream. Preferred agents for forming a protective layer are oxidizing agents such as steam or $O_2$ and nitriding agents such as $N_2$.

Due to the high velocity and high temperature of the inert gas stream, the protective layer-forming agent is evenly distributed by turbulence and diffusion throughout the inert gas stream. For example, when an oxidizing gas is injected into an argon gas stream, the workpiece surface to be treated is bathed with a high-velocity gas mixture of argon and oxidizing gas. In the case of Zircaloy components, a uniform "black" oxide, constituting the protective layer, is formed rapidly on the surface of the workpiece being treated. Alternatively, the protective layer could be a different coating formed by reaction of the workpiece surface with a different agent added to the inert gas, e.g., a nitride coating formed by the addition of a nitriding agent such a $N_2$ gas.

The method of the invention results in metal or alloy components having improved resistance to corrosion. Scrubbing of surfaces by placing the workpiece in a high-velocity gas stream of argon or other inert gas at temperatures which facilitate removal of contaminants does not chemically alter the surface of the metal or alloy material. Simultaneous with the scrubbing operation, the impurities are captured in a separated loop of one or more "getter" filters operating at optimized temperatures. The scrubbing and "getting" functions are followed by a rapid elevation of the temperature of the workpiece by heating the inert gas, now essentially free of contaminants which would otherwise react with the workpiece surface at the elevated temperatures. Thereafter, a specific protective layer-forming agent is introduced into the inert gas stream at an ideal temperature, which agent will react predictably with the workpiece being treated and form a predetermined uniform protective coating on its surface. Upon completion of the reaction between the workpiece surface and the injected agent, the material is cooled rapidly to a temperature such that exposure to normal room ambient conditions will not affect the uniform protective surface condition just created.

Although the method of the invention is ideally suited for cleaning and treating Zircaloy components, it has application in the cleaning and treatment of components made of other alloys, e.g., aluminum, magnesium, titanium and nickel alloys and stainless steels. The steps of this method can be carried out rapidly due to the excellent thermal and transport capabilities of high-velocity gas flow, thereby creating a process sequence for treating metal or alloy components having improved productivity relative to existing processes for cleaning and treating metal or alloy surfaces.

BRIEF DESCRIPTION OF THE DRAWING

A preferred embodiment of the invention will be described in detail with reference to the drawing, which is a schematic diagram of a system for hot argon cleaning and protective coating of components made of metal or alloy.

DETAILED DESCRIPTION OF THE PREFERRED EMBODIMENT

A preferred embodiment of the treatment system in accordance with the invention comprises a treatment chamber generally designated 2, a fluid recirculation circuit generally designated 4 and a getter loop generally designated 6 in the drawing.

Treatment chamber 2 comprises an airtight housing 8 provided with suitable access means (not shown) for the introduction and removal of the workpieces being treated. Housing 8 has an outlet 10 in fluid communication with the inlet of fluid recirculation circuit 4 and an inlet 12 in fluid communication with the outlet of fluid recirculation circuit 4. Inert gas is pumped into airtight housing 8 via inlet 12. After the inert gas has scrubbed the workpiece surface inside airtight housing 8, inert gas laden with contaminants picked up from the workpiece surface exits housing 8 via outlet 10.

The flow of inert gas inside treatment chamber 2 is directed by a rigid baffle structure 14 securely mounted inside housing 8. Baffle structure 14 includes a horizontally disposed upper annular support **14*a*, the outer periphery of which is welded to the wall of housing 8, thereby securely mounting the baffle inside the housing. Baffle structure 14 further comprises vertically disposed lower and upper circular cylindrical baffles 14*b* and 14*c* rigidly supported by upper support 14*a*. Finally, a horizontally disposed lower annular support 14*d* has an outer periphery welded to the bottom of lower circular cylindrical baffle 14*b* and is rigidly supported thereby. Upper and lower supports 14*a* and 14*d* each have a circular aperture for receiving a vertically disposed cylindrical wind tunnel 16**, which is welded to the supports and rigidly supported thereby.

If the workpiece being treated is conventional Zircaloy fuel cladding, the wind tunnel will be circular cylindrical with a diameter greater than the outer diameter of the cladding. The cladding is hung from the top of the treatment chamber by any conventional means such that it is disposed concentrically inside the wind tunnel 20. Obviously, the geometry and size of the wind tunnel will vary depending on the geometry and size of the workpiece being treated, with the goal of minimizing the inert gas flow rate through the wind tunnel.

As inert gas is pumped at high velocity into treatment chamber 2 via inlet 12, the inert gas fills the annular space 18 between housing 8 and baffle **14*b* and flows vertically downward. In the lower plenum 19, the inert gas changes direction and enters the cylindrical channel 20 of wind tunnel 16. The inert gas flows through channel 20 at high velocity, scrubbing the surfaces of the fuel cladding. To satisfactorily perform the scrubbing operation in accordance with the invention, the velocity of the inert gas inside channel 20** should be on the order of or greater than 100 ft/sec.

During the scrubbing operation, the inert gas picks up residue from the workpiece surfaces and then exits channel 20. The contaminated inert gas changes direction in upper plenum 21, enters annular space 22 and then exits the treatment chamber via outlet 10.

The inert gas exiting the treatment chamber 2 is recirculated back into the treatment chamber by the fluid recirculation circuit 4, which comprises in flow sequence: a conduit 24 in fluid communication with outlet 10, a heat exchanger 26 for cooling the inert gas, a conduit 28, a pump 30, a conduit 32, a valve 34, a conduit 36, a heater 38 for heating the inert gas and a conduit 40 in fluid communication with inlet 12. Heat exchanger 26 cools the inert gas to avoid overheating of pump 30. A circuit portion comprising in flow sequence a valve 42, a conduit 44 and a heat exchanger 46 for cooling the inert gas is connected in parallel with the circuit portion comprising valve 34, conduit 36 and heater 38. During scrubbing of the workpiece, the inert gas is cooled by heat exchanger 46 (valve 34 is closed and valve 42 is open). In contrast, during formation of a protective layer on the surface of the workpiece, the inert gas is heated by heater 38 (valve 34 is open and valve 42 is closed).

In accordance with the invention, a portion of the recirculated inert gas stream carrying vaporized contaminants is diverted to a getter subsystem 6 comprising a plurality of getter loops arranged in parallel. The getter subsystem comprises conduits 50 and 52 in fluid communication with conduits 32 and 28 respectively of the recirculation circuit. Each getter loop comprises a valve 54 in fluid communication with conduit 50, a heater 56 and a getter 58 in fluid communication with conduit 52.

Each getter 58 is designed to capture a specific type of contaminant in gaseous/vapor form by reaction with and/or adsorption by an appropriate getter material. In accordance with the invention, conventional getter material can be used, the specific getter material selected being dependent on the specific contaminant sought to be removed from the inert gas stream. For example, the getter material may comprise any one of a class of alloys having the essential components of nickel, titanium and zirconium, as taught by U.S. Pat. No. 4,200,460 to Grossman et al. The ternary alloy disclosed in that patent is capable of serving as a scavenger for cleaning inert gases by removing gaseous impurities through a chemical reaction between the alloy and the gases to be removed from the inert gases.

Preferably the getter should have the property of reacting with hydrogen, other reactive gases such as carbon monoxide, carbon dioxide, oxygen and nitrogen, and hydrogen-containing compounds such as hydrocarbons. As taught by U.S. Pat. No. 4,200,460, one class of alloys having the foregoing property are alloys having the essential components zirconium, nickel and titanium, particularly those alloys containing 3–12 wt.% nickel, 3–30 wt.% titanium and the balance being zirconium. These alloys can be classified as zirconium-base alloys and the composition ranges given above produce alloys having at least about 0.5 vol. % of an intermetallic nickel-containing phase. Representative of the intermetallic nickel-containing phases in the alloy are $NiZr_2$ and $Ni(0.9Zr, 0.1Ti)_2$. The alloys have a metallic appearance and metallographic examination shows the alloys are medium grained having an average grain size of about 10 microns.

The foregoing alloy effectively captures water, water vapor and gases reactive with nuclear fuel cladding when the alloy is disposed in a hollow gas-permeable container, such as that disclosed in U.S. Pat. No. 3,899,392 to Grossman et al. Such a container is preferably made from a metallic, e.g., stainless steel, screen material which houses the ternary alloy or other suitable getter material. The getter material is preferably in particulate form to maximize the surface area per unit volume of the getter material which is available to react with gases and liquids carried or entrained in the diverted inert gas stream. The screen material has a mesh sized to retain the particles of getter material inside the housing.

The above-described ternary alloys serve as scavengers for cleaning contaminants from the recirculating inert gas during the scrubbing operation, at which time valves 54 are open. During formation of the protective layer, on the other hand, valves 54 are closed to prevent exposure of the getter material to the heated inert gas stream with oxidizing or nitriding agent. Such exposure is to be avoided to prevent the getter material from being coated with oxide or nitride, which coating would interfere with the "getting" function.

In accordance with the preferred embodiment of the invention, the levels of targeted gas contaminant are monitored by a gas contaminant measurement device 64 which is in fluid communication with conduit 24. When gas contaminant measurement system 64 detects an acceptable gas purity level, the inert gas stream is heated to a temperature at which the workpiece surface is readily amenable to attaining a uniform protective surface condition in response to injection of a prescribed weight of the protective layer-forming agent into the inert gas stream. The protective layer-forming agent can be injected into conduit 24 from a reactant source 60 via a valve 62.

Due to the high velocity and high temperature of the inert gas stream, the protective layer-forming agent is evenly distributed by turbulence and diffusion throughout the inert gas stream. When the gas stream recirculates into the treatment chamber, the workpiece surface is bathed with the high-velocity gas mixture of inert gas and protective layer-forming agent. A uniform protective layer is formed rapidly on the surface of the workpiece being treated. In the case of a Zircaloy workpiece, if an oxidizing agent is injected, the protective layer formed is a uniform "black" oxide coating.

The gas contaminant measurement system 64 monitors (and uses as a control) the sudden peaking of the protective layer-forming agent upon introduction and the rapid depletion of the agent as the reaction between the workpiece surface and the agent goes to completion. In response to depletion of the protective layer-forming agent, valve 34 is closed and valve 42 is opened. The heat exchanger 46 rapidly cools the inert gas stream, thereby rapidly cooling the workpiece to an acceptable temperature for removal so that subsequent workpieces may be processed.

In accordance with the invention, a uniform protective surface condition is achieved on the surfaces of metal or alloy components after hot scrubbing with high-velocity inert gas. The method is especially suited for the treatment of fuel cladding and fuel channels for a boiling water reactor made from Zircaloy. The preferred inert gas is argon, although any other suitable inert gas could be used. The preferred protective layer is an oxide formed by reaction with an oxidizing agent, e.g., steam or $O_2$. However, any other suitable type of protective layer could be used, for example, a nitride formed by reaction of the workpiece surface with a nitriding agent, e.g., $N_2$, injected into the inert gas stream.

These and other variations and modifications of the disclosed preferred embodiment will be readily apparent to practitioners skilled in the fabrication and treatment of metal or alloy components for use in a nuclear reactor or other corrosive environment. All such variations and modifications are intended to be encompassed by the claims set forth hereinafter.

I claim:

1. An apparatus for treating surfaces of a component made of metal or metal alloy, comprising:

an airtight treatment chamber having an inlet and an outlet;

a cylindrical wind tunnel mounted inside said treatment chamber and having an inlet in fluid communication with said treatment chamber inlet and having an outlet in fluid communication with said treatment chamber outlet;

a baffle structure which blocks a flow of gas from said treatment chamber inlet to said treatment chamber outlet except through said wind tunnel, said baffle structure being connected to said treatment chamber and to said wind tunnel;

recirculation means having an outlet connected to said treatment chamber inlet and having an inlet connected to said treatment chamber outlet;

means for pumping gas through said recirculation means with a force sufficient to cause a high-velocity stream of gas to flow through said wind tunnel during recirculation of said gas through said recirculation means; and a getter loop connected in parallel with a portion of said recirculation means, said getter loop comprising:

getter means for removing a contaminant from gas flowing therethrough;

a first conduit in fluid communication with said recirculation means and with said getter means for diverting a portion of the recirculating gas to said getter means; and a second conduit in fluid communication with said getter means and with said recirculating means for returning said diverted portion of said recirculating gas from said getter means to said recirculation means, wherein said getter means reduces the amount of said contaminant contained in said recirculating gas.

2. The apparatus as defined in claim 1, further comprising means for heating flowing gas, said heating means being in fluid communication with said first conduit and with said getter means for heating said diverted portion of said recirculating gas before it flows through said getter means.

3. The apparatus as defined in claim 1, further comprising a valve means and a source of a protective layer-forming gas, said protective layer-forming gas source being selectively placed in fluid communication with said recirculation means by operation of said valve means.

4. The apparatus as defined in claim 1, further comprising means for measuring the level of a particular gas component of said recirculating gas, said measuring means being in fluid communication with said recirculation means.

5. The apparatus as defined in claim 1, wherein said recirculation means comprise gas heating means and gas cooling means arranged in parallel, and valve means for selectively directing the flow of recirculating gas through one of said gas heating means and gas cooling means.

6. An apparatus for treating surfaces of a component made of metal or metal alloy, comprising:

an airtight treatment chamber having an inlet and an outlet;

a cylindrical wind tunnel mounted inside said treatment chamber, said wind tunnel having an inlet in fluid communication with said treatment chamber inlet and having an outlet in fluid communication with said treatment chamber outlet;

a baffle structure which blocks a flow of gas from said treatment chamber inlet to said treatment chamber outlet except through said wind tunnel, said baffle structure being connected to said treatment chamber and to said wind tunnel, said treatment chamber inlet, said wind tunnel and said baffle structure being arranged such that said wind tunnel inlet is in fluid communication with said treatment chamber inlet only via an annular space which surrounds said wind tunnel;

recirculation means having an outlet connected to said treatment chamber inlet and having an inlet connected to said treatment chamber outlet; and means for pumping gas through said recirculation means with a force sufficient to cause a high-velocity stream of gas to flow through said wind tunnel during recirculation of said gas through said recirculation means.

* * * * *